US009808835B2

(12) United States Patent
Yamaguchi et al.

(10) Patent No.: US 9,808,835 B2
(45) Date of Patent: Nov. 7, 2017

(54) SORTING DEVICE

(71) Applicant: Panasonic Intellectual Property Management Co., Ltd., Osaka (JP)

(72) Inventors: Naoshi Yamaguchi, Osaka (JP); Masatoshi Miyasaka, Osaka (JP); Shingo Hamada, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/099,594

(22) Filed: Apr. 15, 2016

(65) Prior Publication Data

US 2016/0332200 A1 Nov. 17, 2016

(30) Foreign Application Priority Data

May 14, 2015 (JP) ..... 2015-099349

(51) Int. Cl.
*B07C 5/36* (2006.01)
*B07C 5/34* (2006.01)

(52) U.S. Cl.
CPC ..... *B07C 5/366* (2013.01); *B07C 5/34* (2013.01); *B07C 5/362* (2013.01); *B07C 5/368* (2013.01)

(58) Field of Classification Search
CPC ..... B07C 5/363; B07C 5/365; B07C 5/366; B07C 5/367; B07C 5/368; B07B 4/025
See application file for complete search history.

(56) References Cited

U.S. PATENT DOCUMENTS 4,848,590 A 7/1989 Kelly
5,297,667 A * 3/1994 Hoffman ..... B65G 21/2054 198/493
5,819,373 A * 10/1998 Schlichter ..... B07C 5/342 19/0.21
5,862,919 A 1/1999 Eason
6,003,681 A * 12/1999 Wilbur ..... A24B 1/04 209/638
6,646,218 B1 11/2003 Campbell et al.
6,891,119 B2 * 5/2005 Grubbs ..... B03B 9/061 209/587
7,543,710 B2 6/2009 Smith et al.
(Continued)

FOREIGN PATENT DOCUMENTS

JP 9-089768 4/1997
JP 2001-327923 11/2001
(Continued)

*Primary Examiner* — Joseph C Rodriguez
(74) *Attorney, Agent, or Firm* — Panasonic IP Management; Kerry S. Culpepper

(57) ABSTRACT

At a conveyor forefront portion, velocity distribution of an airflow is provided. The velocity distribution is wind velocity distribution in a vertical direction of an airflow from a surface of an upper rectifying plate to a surface of a conveyor at the conveyor forefront portion, and has a maximum value in a range of less than 10 mm downward of the vertical direction from the rectifying plate surface. Moreover, a ratio obtained by dividing the maximum value by a wind velocity in the vicinity of the surface of the conveyor is 4 or more, and 12 or less. In a range other than the range of less than 10 mm, the airflow has a wind velocity equal to the wind velocity in the vicinity of the surface of the conveyor.

5 Claims, 15 Drawing Sheets

(56) References Cited

U.S. PATENT DOCUMENTS

| | | | | |
|---|---|---|---|---|
| 7,816,616 | B2 * | 10/2010 | Kenny | B07C 5/342 209/576 |
| 8,857,621 | B2 * | 10/2014 | Campbell | B07B 1/14 209/44.2 |
| 9,199,283 | B2 * | 12/2015 | Kojima | B07C 5/368 |
| 9,381,546 | B2 * | 7/2016 | Miyasaka | B29B 17/02 |
| 2004/0245156 | A1 | 12/2004 | Gaddis et al. | |
| 2008/0105597 | A1 * | 5/2008 | Miller | B03B 9/06 209/1 |
| 2010/0193332 | A1 * | 8/2010 | Beyerer | B07C 5/366 198/604 |
| 2015/0231671 | A1 | 8/2015 | Miyasaka et al. | |
| 2016/0175889 | A1 * | 6/2016 | Yamaguchi | B07C 5/368 209/644 |

FOREIGN PATENT DOCUMENTS

| | | |
|---|---|---|
| JP | 2003-166879 | 6/2003 |
| JP | 2003-275692 | 9/2003 |
| JP | 2010279921 A * | 12/2010 |
| JP | 2014-188452 | 10/2014 |
| WO | 2014/174736 | 10/2014 |

* cited by examiner

WIND VELOCITY ON FLIGHT PATH (H=30mm)

WIND VELOCITY ON FLIGHT PATH (H=50mm)

FIG. 5A

| | WIND VELOCITY DISTRIBUTION [m/s] | | FLIGHT VARIATION 3σ [mm] | |
|---|---|---|---|---|
| MEASUREMENT POINT | CONDITIONS OF PRESENT EXAMPLE (H=50mm) | CONDITIONS OF COMPARATIVE EXAMPLE | CONDITIONS OF PRESENT EXAMPLE (H=50mm) | CONDITIONS OF COMPARATIVE EXAMPLE |
| P0 | 3.01 | 3.2 | - | - |
| P1 | 3.11 | 3.1 | 13.3 | 19.9 |
| P2 | 3.33 | 2.7 | 24.7 | 35.8 |
| P3 | 3.62 | 2.4 | 38.1 | 47.76 |

FIG. 5B

| | SORTING PURITY | | COLLECTION RATE | |
|---|---|---|---|---|
| NOZZLE GROUP/COLLECTION TYPE | CONDITIONS OF PRESENT EXAMPLE (H=50mm) | CONDITIONS OF COMPARATIVE EXAMPLE | CONDITIONS OF PRESENT EXAMPLE (H=50mm) | CONDITIONS OF COMPARATIVE EXAMPLE |
| FIRST NOZZLE GROUP / PS | 99.8% | 99.1% | 91.6% | 84.5% |
| SECOND NOZZLE GROUP / PP | 99.7% | 99.6% | 96.1% | 75.2% |
| THIRD NOZZLE GROUP / ABS | 99.8% | 92.3% | 95.7% | 35.3% |

FIG. 8

| MEASUREMENT POINT | VARIATION IN ARRIVAL TIME OF SMALL RESIN PIECE 3σ | FLIGHT VARIATION 3σ |
|---|---|---|
| P101 | 6.76ms | 19.9ms |
| P102 | 12.18ms | 35.8ms |
| P103 | 16.25ms | 47.8ms |

SORTING DEVICE

BACKGROUND

1. Technical Field

The present disclosure relates to a sorting device that sorts small pieces made of a specific material type from sorting objects constituted by collecting a plurality of small pieces, and particularly, relates to a sorting device that sorts small pieces of a specific resin type from sorting objects obtained by crushing used home electric appliances or the like.

2. Description of the Related Art

Recent economic activities based on mass-production, mass-consumption, and mass-disposal have caused global environmental problems such as global warming, resource depletion and the like. Under such a situation, home electric appliance recycling has attracted attention, and recycling of a used air conditioner, television, refrigerator, freezer, and washing machine is required for construction of a recycling-based society.

Conventionally, a useless home electric appliance is crushed into small pieces in a home electric recycling factory, and then the small pieces are separated by material type, using magnetism, wind power, vibration or the like for resource recovery. Particularly, use of a specific gravity sorting device or a magnetic sorting device allows small pieces made of metal to be separated with high purity by material type such as iron, copper, aluminum and the like, which realizes a high resource recovery rate.

On the other hand, in a resin material, small pieces made of polypropylene (hereinafter, referred to as PP), which is a light specific gravity matter, are sorted from a high specific gravity matter in specific gravity sorting using water to be collected with relatively high purity. However, in the specific gravity sorting using water, there are major problems that a large amount of discharged water is produced, and that small pieces made of polystyrene (hereinafter, referred to as PS) and small pieces having a close specific gravity such as small pieces made of acrylonitrile-butadiene-styrene (hereinafter, referred to as ABS) cannot be separated.

A sorting method in view of the above-described problems regarding the resource recovery of the resin materials has been proposed in Patent Literature 1. In a technique described in Patent Literature 1 (WO2014/174736), a material type is detected by an identification device, which enables two types of small pieces made of resin materials that cannot be sorted in the specific gravity sorting to be simultaneously sorted.

FIG. 6 is a schematic configuration diagram of a conventional sorting device according to Patent Literature 1.

This sorting device sorts a specific material type matter and another material type matter from sorting objects in which the specific material type matter and the other material type matter other than the specific material type matter are mixed.

Conveyor 101 conveys small resin pieces 102 as the sorting objects placed on conveyor 101 in one direction. Composition of small resin pieces 102 is identified, and at the same time, position information on conveyor 101 is acquired when small resin pieces 102 pass under identification device 103.

Small resin pieces 102 that have reached conveyor forefront portion 104 in a conveyance direction of conveyor 101 fly out horizontally at the same velocity as conveyance velocity V100 of conveyor 101.

Above conveyor forefront portion 104, first assist nozzle 106 that generates airflow 109 at wind velocity V101 that matches conveyance velocity V100 of conveyor 101 is disposed. First upper rectifying plates 107A are disposed along a flight path of small resin pieces 102 above the flight path, and lower rectifying plate 107B is disposed along the flight path obliquely below conveyor forefront portion 104 under the flight path of small resin pieces 102. The above-described configuration enables airflow 109 at the wind velocity that matches the conveyance velocity of conveyor 101 to flow along the flight path of small resin pieces 102 inside the flight path.

Small resin pieces 102 thrown out in the horizontal direction from conveyor 101 falls, flying. On this occasion, pulse air is injected from the nozzles by a command from identification device 103 at a moment when the resin of the relevant specific material type among small resin pieces 102 passes positions where the relevant resin receives the pulse air of the nozzles of first nozzle group 105A and second nozzle group 105B, and only the resin of the relevant specific material type is shot to be collected in a section partitioned by partition plates 108.

If first assist nozzle 106, first upper rectifying plates 107A, and lower rectifying plate 107B are absent, small resin pieces 102 receive the same wind velocity V100 as the conveyance velocity of conveyor 101 from a front in a travelling direction immediately after flying out from conveyor 101, and they receive air resistive force differently, depending on shapes, areas, or weights of small resin pieces 102. In this case, since the flight path differs in respective small resin pieces 102, flight variation is caused, which decreases shooting accuracy at the positions where small resin pieces 102 receive the pulse air of first nozzle group 105A and second nozzle group 105B described later.

However, when first assist nozzle 106, first upper rectifying plates 107A, and lower rectifying plate 107B are installed, first assist nozzle 106 supplies airflow 109 at window velocity V101 matching the conveyance velocity of conveyor 101 in the flying-out direction of small resin pieces 102, and thus, a relative velocity between small resin pieces 102 and airflow 109 at the time of flying-out is almost 0, and the air resistance is also almost 0. Moreover, since first upper rectifying plates 107A and lower rectifying plate 107B maintain airflow 109 at window velocity V101 matching conveyance velocity V100 of conveyor 101 along the flight path, the flight in a state where the air resistance is almost 0 is realized across the flight path.

This action can prevent small resin pieces 102 from receiving the air resistive force inside the flight path regardless of the shapes, the areas, or weights of the resin, thereby suppressing the flight variation of the resin.

As a configuration example, for example, there is an example in which only the small resin pieces 102 of PS among small resin pieces 102 are shot by first nozzle group 105A, and small resin pieces 102 of PP among small resin pieces 102 are shot by second nozzle group 105B. Based on a time when resin small pieces 102 pass under identification device 103, times when small resin pieces 102 pass the positions where small resin pieces 102 receive the pulse air of first nozzle group 105A and second nozzle group 105B are calculated or measured in advance. Subsequently, based on the position information on conveyor 101 measured in identification device 103, at the moment when relevant small resin pieces 102 of PS among small resin pieces 102 pass the position where they receive the pulse air of first nozzle group 105A, and at the moment when relevant small resin pieces 102 of PP among small resin pieces 102 pass the position where they receive the pulse air of second nozzle group 105B, the pulse air is injected to respective relevant small resin pieces 102. With the above configuration, relevant small resin pieces 102 are shot by the pulse air, and the shot resins are collected by type into the sections partitioned by partition plates 108.

The above configuration enables two types of the specific material type matters and the other material type matter to be simultaneously sorted with high accuracy from the sorting objects in which the specific material type matters and the other material type matter are mixed.

However, from consideration by the inventors, it has been clear that in the above conventional configuration, as to the suppression of the flight variation of small resin pieces 102, a flight distance from conveyor forefront portion 104 is realized only in a range of 400 mm to 500 mm at the most, and that because of the limitation of the distance, at most two pairs of nozzle groups 105A, 105B that shoot small resin pieces 102 can be installed. If three pairs of nozzle groups are installed, the flight distance with the flight variation suppressed needs to be at least 600 mm to 700 mm.

In order to realize the above-described flight distance, as shown in FIG. 7, second upper rectifying plate 107C is installed next to first upper rectifying plate 107A along flight path to extend a rectifying effect, and third nozzle group 105C is installed to consider the sorting accuracy.

Here, assuming that conveyor forefront portion 104 is an origin, on an X axis, the conveyance direction is positive, and on a Z axis, a downward direction of a vertical direction is positive, and coordinates of conveyor forefront portion 104 are P100 (X, Z)=(0 mm. 0 mm). At this time, as one example, a position where the object matter passes when receiving the pulse air from first nozzle group 105A is P101 (X, Z)=(250 mm, 60 mm), a position where the object matter passes when receiving the pulse air from second nozzle group 105B is P102 (X, Z)=(450 mm, 160 mm), and a position where the object matter passes when receiving the pulse air from third nozzle group 105C is P103 (X, Z)=(600 mm, 250 mm). Moreover, as one example, conveyance velocity V100 of conveyor 101 is V100=3 m/s, airflow 109 equivalent to the conveyance velocity of conveyor 101 is supplied from first assist nozzle 106 at wind velocity V101=3 m/s±15% to conduct an experiment equivalent to Patent Literature 1.

As used small resin pieces 102, resins different in size that are 10 mm squares to 100 mm squares are used, because the resins having small grain sizes produced when home electric appliance resins are crushed into small pieces by a crusher are objects.

The time when small resin pieces 102 fly out of conveyor forefront portion 104 is 0, the times when small resin pieces 102 pass the positions where they receive the pulse air of first nozzle group 105A, second nozzle group 105B, and third nozzle group 105C are defined as t101, t102, and t103, respectively, and in order to measure the times, a high-speed camera (HAS-L1M 500FPS by DITECT) and image analysis software are prepared for measurement.

In FIG. 8, if variation in arrival time of small resin pieces at positions P101, P102, and P103 where the pulse air from first nozzle group 105A, second nozzle group 105B, and third nozzle group 105C is received is indicated by 3σ, and with the flight velocity in the X direction V100=3 m/s, the conversion to the flight variation of small resin pieces 102 is performed.

As a result, in some of small resin pieces 102, at position P101 where the pulse air of first nozzle group 105A is received, a shooting timing shift by 6.76 ms is caused. Moreover, at position P102 where the pulse air of second nozzle group 105B is received, a shooting timing shift by 12.18 ms is caused. Moreover, at position P103 where the pulse air of third nozzle group 105C is received, a shooting timing shift by 16.25 ms is caused. Converted to the distance, at time points when the nozzle groups inject the pulse air, a shift by up to 19.9 mm is caused at position P101 where the pulse air of first nozzle group 105A is received, a shift by up to 35.8 mm is caused at position P102 where the pulse air of second nozzle group 105B is received, and a shift by up to 47.8 mm is caused at position P103 where the pulse air of third nozzle group 105C is received.

For installing three or more stages of nozzle groups and simultaneously sorting three types of small resin pieces 102, the flight distance to third nozzle group 105C is required to be at least 600 mm, and across this flight distance, the flight variation needs to be suppressed. The inventors have considered that for this, wind velocity V101 of airflow 109 inside the flight path needs to be further controlled.

FIG. 9A is a schematic diagram showing gravity and fall velocity acting when an object is thrown out in the horizontal direction from conveyor 101 if a gravitational acceleration is g and there is no air resistance. The horizontal direction is an X axis on which a right hand in the horizontal direction is positive, and the vertical direction is a Z axis on which a downward direction in the vertical direction is positive. If a velocity of the object thrown out in the horizontal direction from conveyor 101 is Vx, in the X axis direction, constantly Vx=V100. As to velocity Vz of the object in the vertical direction at a position where the object advances by X in the horizontal direction, Vz=g (X/V100). Thus, the fall velocity in a traveling direction of the object, that is, velocity in a fall parabola tangent direction V is represented by expression (1).

$$V=f\{g(X/V100)\}^2+V100^2]^{1/2} \quad (1)$$

FIG. 9B is a graph showing calculation of the fall velocity, where, as one example, conveyor velocity V100=3 m/s, as to an initial velocity of small resin pieces 102 as well, V100=3 m/s, the air resistance is ignored, and the fall velocity follows expression (1).

At position X=250 mm where the pulse air of first nozzle group 105A is received, fall velocity V=3.11 m/s. At position X=450 mm where the pulse air of second nozzle group 105B is received, fall velocity V=3.34 m/s. At position X=600 mm where the pulse air of third nozzle group 105C is received, fall velocity V=3.58 m/s. In the method of Patent Literature 1, since the wind velocity of airflow 109 matches 3 m/s along the flight path, the longer the flight path becomes, the larger shift is caused between wind velocity V101 of airflow 109 and fall velocity V, and the air resistance is received, which is assumed to be a cause of the flight variation.

Namely, in the conventional configuration, when small resin pieces 102 as the sorting objects fall along the flight path, even if the wind velocity of airflow 109 supplied from first assist nozzle 106 is set to be equal to the initial velocity of the resin, as the flight distance becomes longer, fall velocity V is increased by the gravity, and the fall velocity becomes higher than the wind velocity of the airflow. Therefore, the longer the flight path becomes, the air resistive force is acted differently, depending on the shape, the area, or the weight of the resin. This poses a problem that the flight variation is caused, so that the shooting accuracy is decreased at a flight distance described in Patent Literature 1 or longer.

SUMMARY

The present disclosure is to solve the conventional problem, and an object thereof is to provide a sorting device that enables three types of resin to be sorted simultaneously.

In order to achieve the above object, a sorting device according to one aspect of the present disclosure is a sorting device that sorts a specific material type matter and another material type matter from sorting objects, and includes a conveyor, an identification part, an air blower, an upper rectifying plate, a lower rectifying plate, and a plurality of injectors. The conveyor conveys the sorting objects in a placed state in one direction, the sorting objects having the specific material type matter and the other material type matter other than the specific material type matter mixed, and causes the sorting objects to fly at a forefront portion of the conveyor.

The identification part identifies composition of the specific material type matter placed on the conveyor.

The air blower generates an airflow in a flying-out direction of the sorting objects.

The upper rectifying plate is disposed along a flight path of the sorting objects above the flight path.

The lower rectifying plate is disposed along the flight path obliquely below the forefront portion of the conveyor under the flight path.

The plurality of injectors are disposed above the flight path so as to be directed to the flight path, and inject pulse air to the specific material type matter flying from the conveyor.

Wind velocity distribution in a vertical direction of the airflow from a surface of the upper rectifying plate to a surface of the conveyor at the forefront portion of the conveyor has a maximum value in a range of less than 10 mm downward in the vertical direction from the surface of the upper rectifying plate. A ratio obtained by dividing the maximum value by a wind velocity in the vicinity of the surface of the conveyor is 4 or more, and 12 or less. In a range other than the range of less than 10 mm, the airflow has a wind velocity equal to the wind velocity in the vicinity of the surface of the conveyor.

As described above, in the one aspect of the present disclosure, since resin as sorting objects increases a wind velocity along a flight path so that it substantially does not receive air resistance, a sorting device in which at least three nozzle groups that inject pulse air can be installed, and flight variation is suppressed can be realized, and three types of resin can be simultaneously sorted.

BRIEF DESCRIPTION OF DRAWINGS

FIG. 5A is a diagram showing comparison of the wind velocity distribution and flight variation between an example of the present disclosure and a comparative example;

FIG. 5B is a diagram showing comparison of sorting accuracy and a collection rate between the example of the present disclosure and the comparative example;

FIG. 8 is a diagram showing variation in arrival time of the small resin pieces and flight variation in the conventional sorting device;

DETAILED DESCRIPTION

Hereinafter, an exemplary embodiment of the present disclosure will be described with reference to the drawings.

Exemplary Embodiment

Figure 1A:
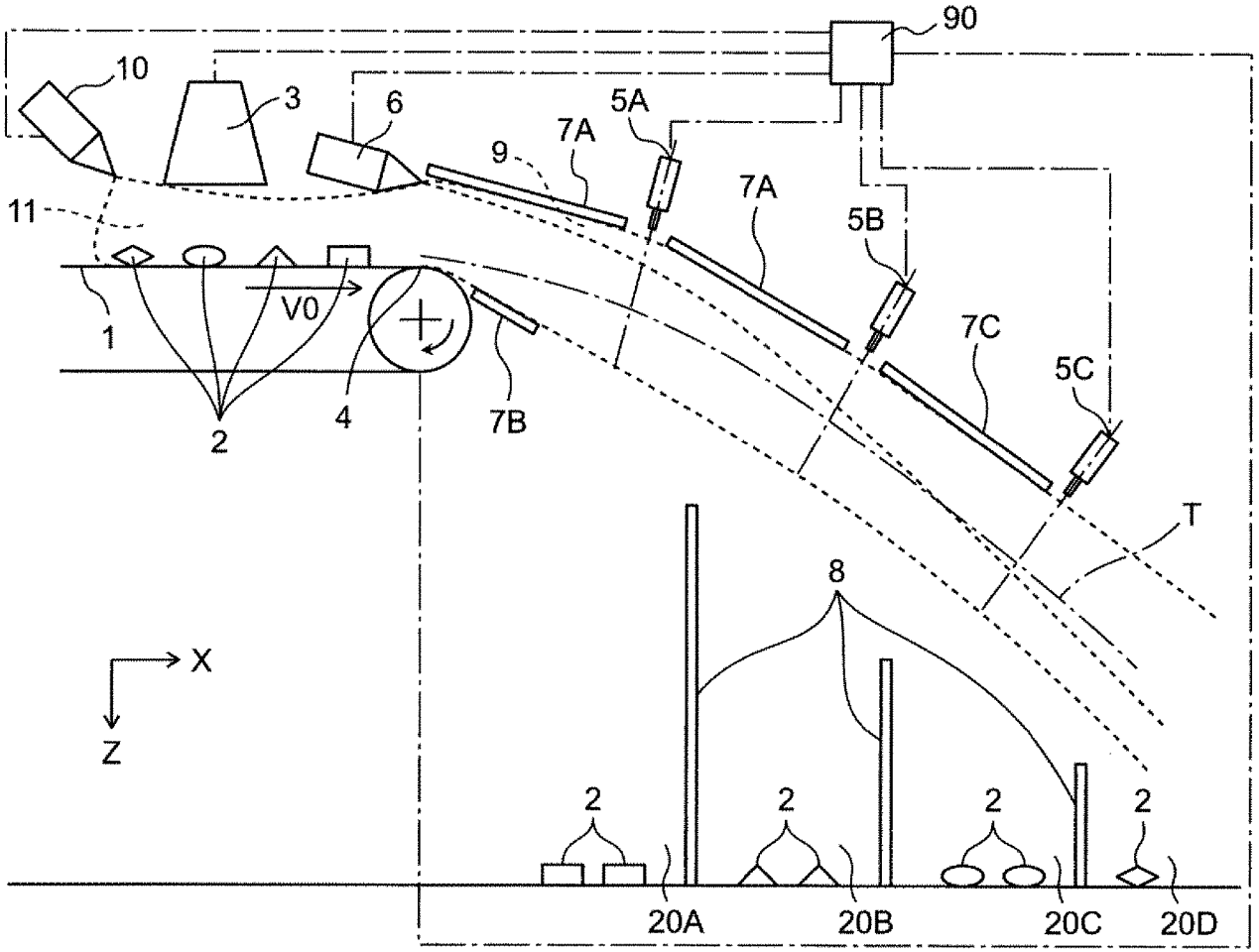
FIG. 1A is a schematic configuration diagram of a sorting device in one exemplary embodiment of the present disclosure.

FIG. 1A is a side view of a sorting device in one exemplary embodiment of the present disclosure.

The sorting device includes conveyor 1 as one example of a conveyance device, first assist nozzle 6 as one example of a first air blower, identification device 3 as one example of an identification part, first upper rectifying plates 7A, second upper rectifying plate 7C, lower rectifying plate 7B, first nozzle group 5A, second nozzle group 5B, and third nozzle group 5C as one example of a plurality of injectors, and second assist nozzle 10 as one example of a second air blower. Furthermore, the identification device also includes control device 90. Control device 90 controls operations of conveyor 1, first assist nozzle 6, identification device 3, and the plurality of nozzle groups 5A, 5B, 5C, and second assist nozzle 10. The sorting device is a sorting device that sorts a specific material type matter and another material type matter from sorting objects in which the specific material type matter and the other material type matter other than the specific material type matter are mixed. The first air blower and the second air blower function as one example of an air blower. First upper rectifying plates 7A and second upper rectifying plate 7C function as examples of an upper rectifying plate.

In FIG. 1A, conveyor 1 conveys small resin pieces 2, which are the sorting objects placed on conveyor 1, in one direction (in a right direction in FIG. 1A). Small resin pieces 2 that reach conveyor forefront portion 4 in a conveyance direction of conveyor 1 fly out in a horizontal direction at the same velocity as conveyance velocity V0 of conveyor 1.

Above a forefront vicinity of conveyor 1 is disposed identification device 3. When each of small resin pieces 2 on conveyor 1 passes under identification device 3, composition of the relevant small resin piece 2 is identified by identification device 3, and at the same time, position information on conveyor 1 is also acquired by identification device 3.

Above conveyor forefront portion 4 is disposed first assist nozzle 6 as one example of the first air blower that generates first airflow 9. Along a blowing-out direction of a blowing-out port of first assist nozzle 6 from conveyor forefront portion 4 of conveyor 1 is formed flight path T of small resin pieces 2, which gradually curves downward.

Above flight path T of small resin pieces 2, the plurality of planar first upper rectifying plates 7A are disposed adjacent to one another along flight path T from a forefront portion of first assist nozzle 6 to a downstream side of flight path T.

Under flight path T of small resin pieces 2, and obliquely below conveyor forefront portion 4, planer lower rectifying plate 7B is disposed along flight path T.

Between the adjacent plurality of first upper rectifying plates 7A are disposed a plurality of nozzles of first nozzle group 5A as an example of an upstream-side injector, whose blowing-out ports are directed to flight path T. At a downstream-side end portion of first upper rectifying plate 7A on the downstream side of the plurality of first upper rectifying plates 7A are disposed a plurality of nozzles of second nozzle group 5B as one example of an injector in an intermediate portion, whose blowing-out ports are directed to flight path T.

On the further downstream side of the nozzles of second nozzle group 5B, planar second upper rectifying plate 7C is disposed along flight path T. At a downstream-side end portion of second upper rectifying plate 7C are disposed a plurality of nozzles of third nozzle group 5C as one example of a downstream-side injector, whose blowing-out ports are directed to flight path T.

Small resin pieces 2 shot from flight path T are collected in any of four of first to fourth sections 20A, 20B, 20C, 20D partitioned by type by three partition plates 8 different in height and disposed below flight path T.

Moreover, in FIG. 1A, a configuration is such that second assist nozzle 10 as one example of the second air blower is disposed at a position behind first assist nozzle 6 outside flight path T (in FIG. 1A, at the position further behind identification device 3 behind first assist nozzle 6), and that second airflow 11 at a wind velocity equivalent to conveyor conveyance velocity V0 is supplied from a blowing-out port of second assist nozzle 10 to a surface of conveyor 1. First airflow 9 and second airflow 11 function as examples of an airflow.

First assist nozzle 6 above conveyor forefront portion 4 is disposed so that a nozzle forefront of first assist nozzle 6 is located in the vicinity of a surface of first upper rectifying plate 7A on the upstream side. This disposition allows first airflow 9 supplied from first assist nozzle 6 to flow along the surface of first upper rectifying plate 7A immediately after the blowing-out by Coanda effect, and to gradually spread as it flows downstream.

On the other hand, second airflow 11 supplied from second assist nozzle 10 flows along the surface of conveyor 1 in the conveyance direction of conveyor 1 at the wind velocity equivalent to conveyor conveyance velocity V0, flows out from conveyor forefront portion 4 toward flight path T of small resin pieces 2, and gradually spreads as it flows downstream.

Thus, wind velocity distribution of a combined airflow of first airflow 9 and second airflow 11 in the Z axis direction at position x in the X axis direction including flight path T is wind velocity distribution of a combined airflow formed by combining, at conveyor forefront portion 4, first airflow 9 from first assist nozzle 6 at conveyor forefront portion 4 and second airflow 11 supplied from second assist nozzle 10.

When second airflow 11 is supplied from second assist nozzle 10 so that second airflow 11 has the wind velocity equivalent to conveyance velocity V0 of conveyor 1 at conveyor forefront portion 4, small resin pieces 2 that fly out of conveyor forefront portion 4 has a relative velocity 0 and substantially do not receive the air resistance immediately after the flying-out. In addition, first airflow 9 at the wind velocity higher than second airflow 11 at conveyor forefront portion 4 is supplied to the surface vicinity of first upper rectifying plate 7A on the upstream side from first assist nozzle 6, by which first airflow 9 flows along the surface of first upper rectifying plate 7A on the upstream side by the Coanda effect. Thus, first airflow 9 passes above small resin pieces 2 immediately after the flying-out, and gradually spreads downstream. The wind velocity distribution of the combined airflow resulting from combining first airflow 9 and second airflow 11 can increase the wind velocity of the combined airflow along flight path T, and at all positions on flight path T, small resin pieces 2 have the relative velocity 0, and can be substantially prevented from receiving the air resistance.

This makes the flight variation of small resin pieces 2 small, and the resin of the relevant specific material type among small resin pieces 2 can pass the position where the resin receives the pulse air of third nozzle group 5C. Thus, at the moment when the resin passes the position where the resin receives the pulse air of the nozzles of third nozzle group 5C, the pulse air is injected from third nozzle group 5C under the control by control device 90, based on information from identification device 3, and only the resin of the relevant specific material type can be shot from flight path T with high accuracy.

As one configuration example, for example, only small resin pieces 2 of PS among small resin pieces 2 are shot from flight path T by first nozzle group 5A, only small resin pieces 2 of PP among small resin pieces 2 are shot from flight path T by second nozzle group 5B, and only small resin pieces 2 of ABS among small resin pieces 2 are shot from flight path T by third nozzle group 5C. As to small resin pieces 2 shot from flight path T, small resin pieces 2 of PS are collected in first section 20A, small resin pieces 2 of PP are collected in second section 20B, small resin pieces 2 of ABS are collected in third section 20C, and small resin pieces 2 of the resin of the other types are collected in fourth section 20D.

This can increase the wind velocity of the combined airflow along flight path T so that small resin pieces 2 as the sorting objects substantially do not receive the air resistance. This substantially prevents small resin pieces 2 from receiving the air resistance regardless of the shapes, the areas, or the weights of small resin pieces 2 even if the flight distance is long. Therefore, the flight variation of small resin pieces 2 can be suppressed, the shooting accuracy is improved, so that only the relevant specific material type can be sorted from the other material types to be collected in the relevant section.

Here, the operation of shooting small resin pieces 2 from flight path T by the pulse air is performed as follows.

First, based on the time when small resin pieces 2 pass under identification device 3 on conveyor 1, the times when small resin pieces 2 pass the positions where they receive the pulse air of first nozzle group 5A, second nozzle group 5B, and third nozzle group 5C, respectively are calculated or measured in a passage time acquiring part such as an arithmetic operation part inside control device 90.

Subsequently, based on the position information on conveyor 1 measured in identification device 3, under the control of control device 90, at the moment when relevant small resin pieces 2 of PS among small resin pieces 2 pass position P1 where they receive the pulse air of first nozzle group 5A, the pulse air is injected from first nozzle group 5A toward small resin pieces 2 of PS. Furthermore, at the moment when relevant small resin pieces 2 of PP among small resin pieces 2 pass position P2 where they receive the pulse air of second nozzle group 5B, and at the moment when relevant small resin pieces 2 of ABS among small resin pieces 2 pass position P3 where they receive the pulse air of third nozzle group 5C, the pulse air is injected from the relevant nozzles to relevant small resin pieces 2.

With the above configuration, relevant small resin pieces 2 are shot from flight path T by the pulse air, and the shot resin from flight path T is collected by type in any of the four sections of first to fourth sections 20A, 20B, 20C, 20D partitioned by three partition plates 8.

According to this exemplary embodiment, the wind velocity distribution of the combined airflow from the conveyor surface to the surface of first upper rectifying plate 7A at conveyor forefront portion 4 is made proper distribution described later, which can increase the wind velocity along flight path T so that small resin pieces 2 as the sorting objects substantially do not receive the air resistance. Thereby, even if the flight distance of small resin pieces 2 becomes long, small resin pieces 2 substantially do not receive the air resistance regardless of the shapes, the areas, or the weights of small resin pieces 2, which can suppress the flight variation of small resin pieces 2, and improve the shooting accuracy. Accordingly, the three types of specific material type matters and the other material type matters can be simultaneously sorted with high accuracy from the sorting objects in which the specific material type matters and the other material type matters are mixed. Moreover, in a case where in the series of flight path T, small resin pieces 2 made of the three material types are sorted individually, a sorting purity and a collection yield of small resin pieces 2 of the desired specific material type can be increased.

Here, how the wind velocity distribution of the combined airflow is made the proper distribution will be described in the following, based on a specific example.

Example

A method for more surely sorting will be described in detail, based on an example according to the exemplary embodiment of the present disclosure.

Figure 1B:
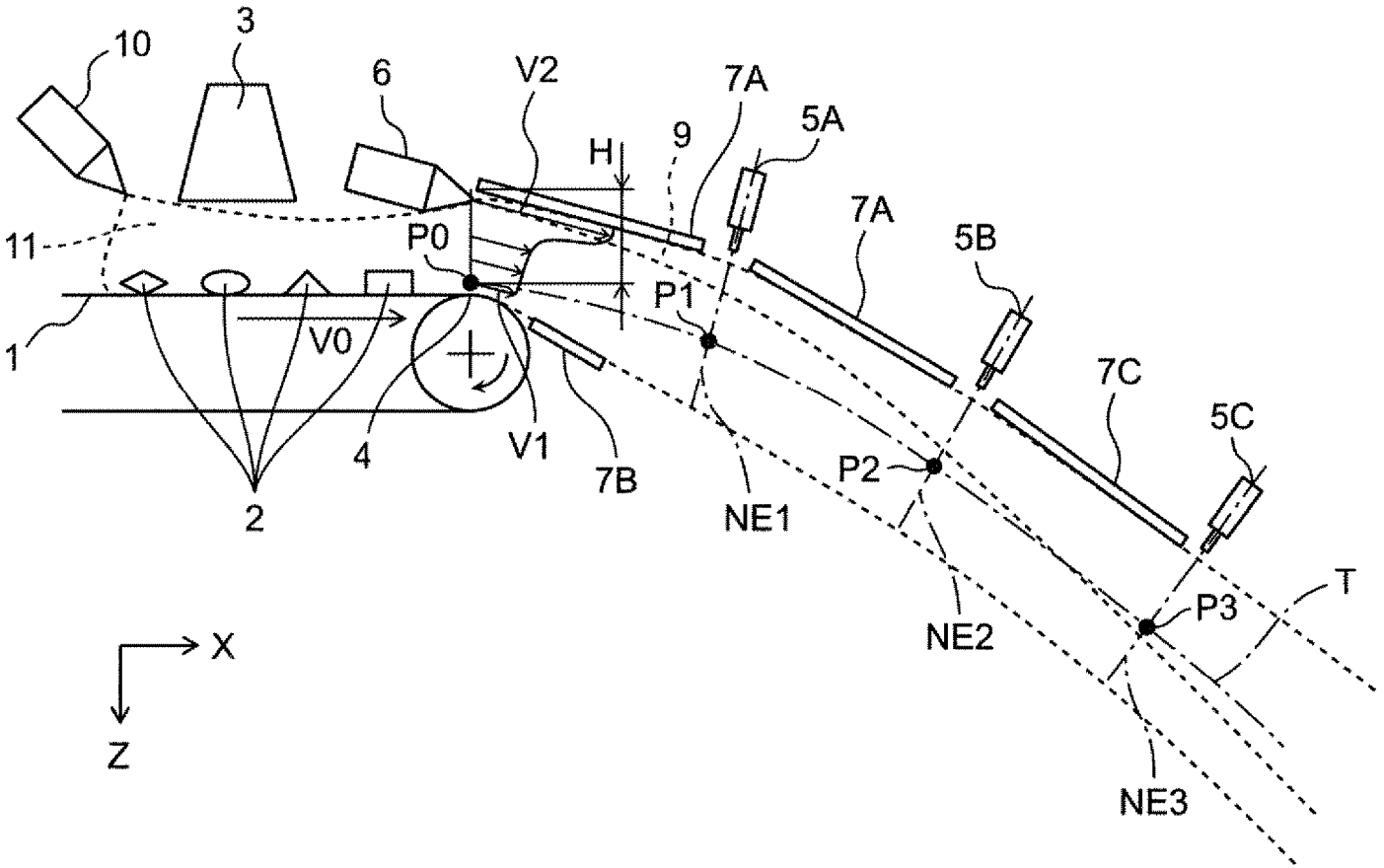
FIG. 1B is a diagram showing components of the sorting device in the exemplary embodiment of the present disclosure.

As shown in FIG. 1B, the conveyance velocity of conveyor 1 is defined as V0, a wind velocity in the vicinity of the conveyor surface at conveyor forefront portion 4 is defined as V1, a maximum wind velocity in the wind velocity distribution in the Z axis direction from the surface of first upper rectifying plate 7A to the surface of conveyor 1 at conveyor forefront portion 4 is defined as V2, and a shortest distance between the surface of first upper rectifying plate 7A and the surface of conveyor 1 at conveyor forefront portion 4 is defined as H.

Based on distance H, wind velocity V1, and wind velocity V2, the wind velocity distribution from the conveyor surface at conveyor forefront portion 4 to the surface of first upper rectifying plate 7A is made the proper distribution, by which the wind velocity distribution on flight path T of small resin pieces 2 that matches flight path T of small resin pieces 2, and matches the fall velocity of small resin pieces 2 can be obtained. In measuring the wind velocity distribution, measurement points on flight path T are defined as follows. First, a point of conveyor forefront portion 4 on flight path T is defined as P0. A point where small resin pieces 2 pass the position where they receive the pulse air of first nozzle group 5A on flight path T, that is, an intersection point between flight path T and nozzle extension line NE1 of first nozzle group 5A is defined as P1. A point where small resin pieces 2 pass the position where they receive the pulse air of second nozzle group 5B on flight path T, that is, an intersection point between flight path T and nozzle extension line NE2 of second nozzle group 5B is defined as P2. A point where small resin pieces 2 pass the position where they receive the pulse air of third nozzle group 5C on flight path T, that is, an intersection point between flight path T and nozzle extension line NE3 of third nozzle group 5C is defined as P3.

As one example, coordinates of points P0, P1, P2, P3 are P0(X, Z)=(0 mm, 0 mm), P1(X, Z)=(250 mm, 60 mm), P2(X, Z)=(450 mm, 160 mm), and P3(X, Z)=(600 mm, 250 mm).

A horizontal flying-out initial velocity of small resin pieces 2 is, as one example, V0=3 m/s, which is equal to conveyance velocity V0 of conveyor 1.

For all the wind velocities measured in this example, a wind velocity/wind temperature prove made by Tohnic (QA-30) is used.

Figure 2A:
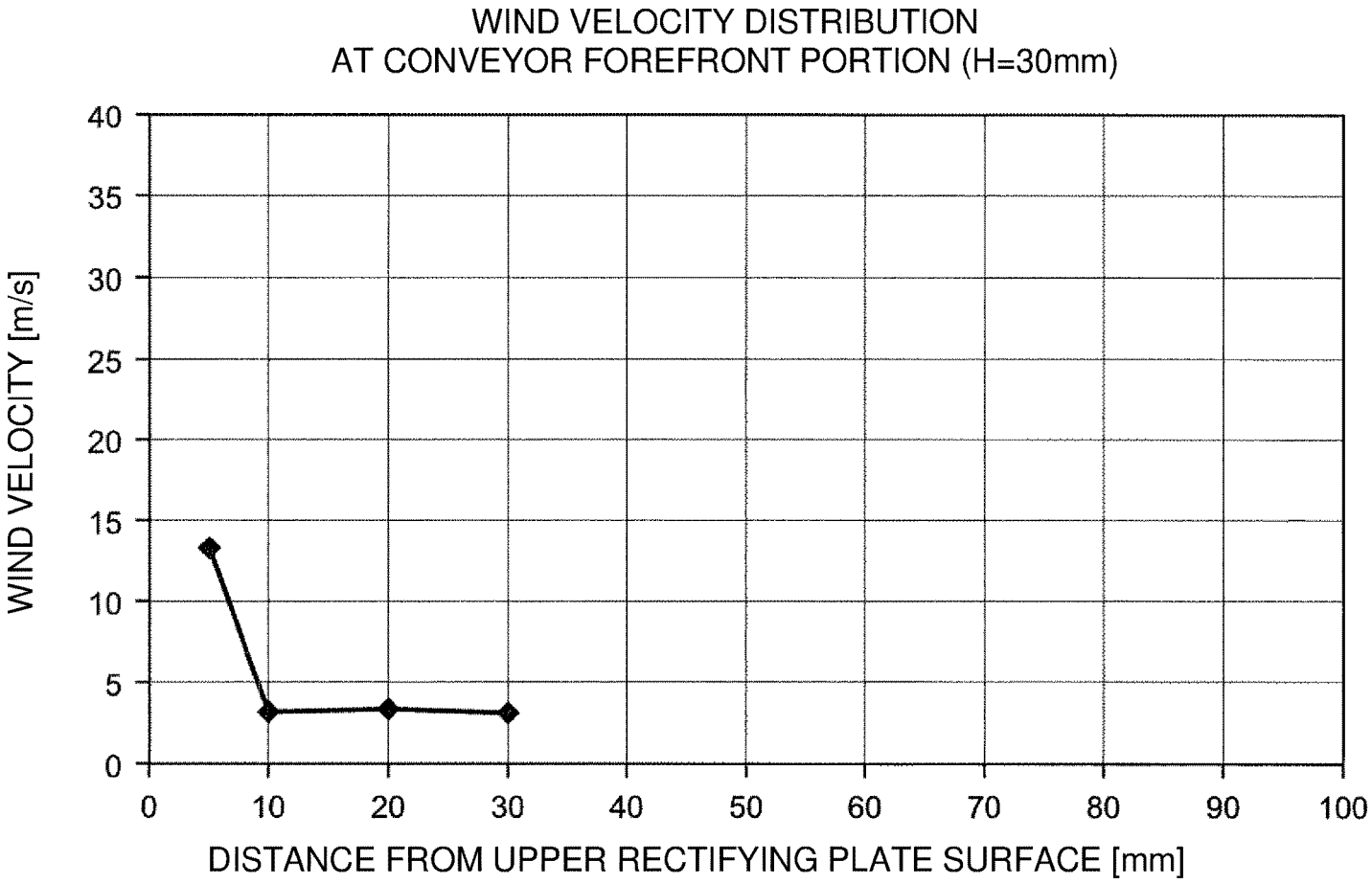
FIG. 2A is a graph showing wind velocity distribution in a Z axis direction from a surface of a first upper rectifying plate to a surface of a conveyor at a conveyor forefront portion in distance H=30 mm.
Figure 2B:
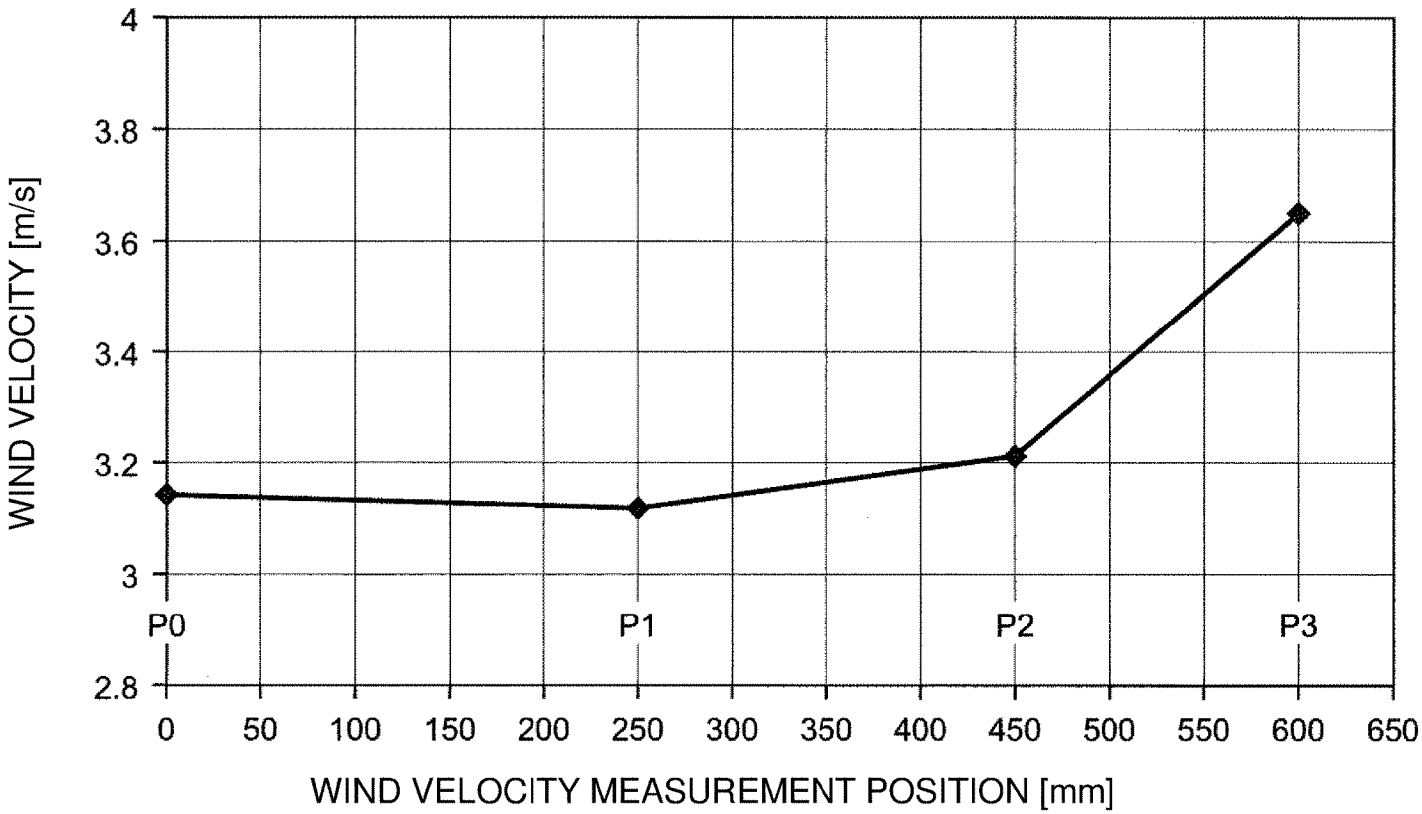
FIG. 2B is a graph showing the wind velocity distribution on a flight path of small resin pieces in distance H=30 mm.

FIG. 2A is a graph showing the wind velocity distribution in the Z axis direction from the surface of first upper rectifying plate 7A to the surface of conveyor 1 at conveyor forefront portion 4. This graph shows a state where first airflow 9 and second airflow 11 are supplied from first assist nozzle 6 and second assist nozzle 10, respectively, wherein in the distance H=30 mm, wind velocity V=3.11 m/s±15% or less at point P1, V=3.34 m/s±15% or less at point P2, and V=3.58 m/s±15% at point P3 are set as target values so that these velocities become equivalent to the fall velocity of small resin pieces 2. FIG. 2B is a graph showing wind velocity results at points P0, P1, P2, P3 at this time.

In FIG. 2A, the wind velocity distribution becomes maximum value V2 at a point of 5 mm in the Z axis direction from the surface of first upper rectifying plate 7A. In a range of 10 mm in the Z axis direction (downward of the vertical direction) from the surface of first upper rectifying plate 7A to the surface of conveyor 1, the wind velocity distribution becomes equivalent to wind velocity V1 in the vicinity of the surface of conveyor 1. Since maximum value of the wind velocity distribution V2=13.23 m/s, and wind velocity in the vicinity of the surface of conveyor 1 V1=3.14 m/s, it can be understood that as to a ratio between the maximum value and the wind velocity in the vicinity of the surface of conveyor 1 (V2/V1), V2/V1=4.21.

When this wind velocity distribution is realized, the combined airflow spreads as it flows downward, and in FIG. 2B, it can be understood that the wind velocity distribution in which the wind velocity of the combined airflow of small resin pieces 2 on flight path T matches an increase in the fall velocity can be realized.

Figure 3A:
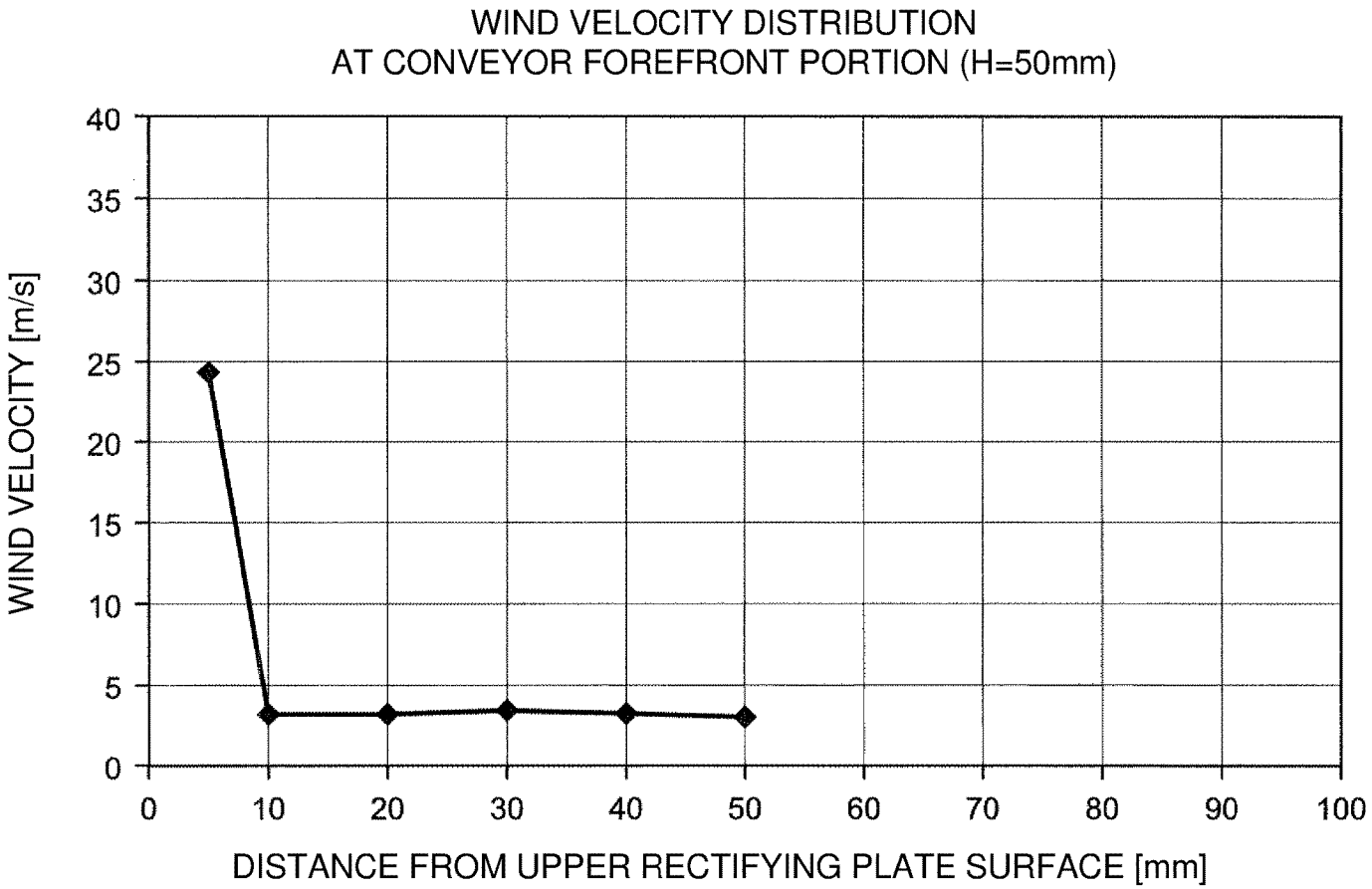
FIG. 3A is a graph showing the wind velocity distribution in the Z axis direction from the surface of the first upper rectifying plate to the surface of the conveyor at the conveyor forefront portion in distance H=50 mm.
Figure 3B:
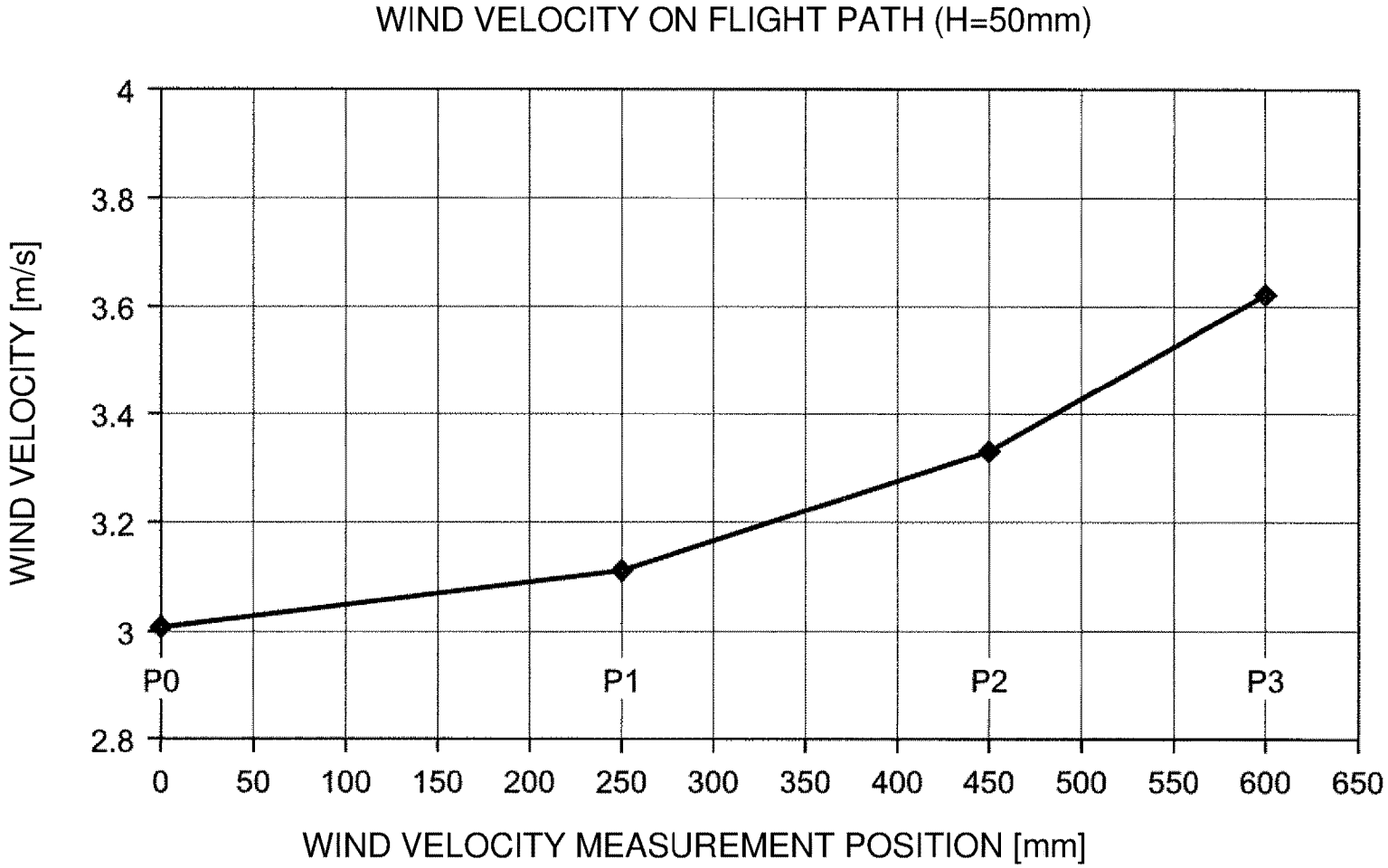
FIG. 3B is a graph showing the wind velocity distribution on the flight path of the small resin pieces in distance H=50 mm.

FIG. 3A is a graph showing the wind velocity distribution in the Z axis direction from the surface of first upper rectifying plate 7A to the surface of conveyor 1 at conveyor forefront portion 4. This graph shows a state where first airflow 9 and second airflow 11 are supplied from first assist nozzle 6 and second assist nozzle 10, respectively, wherein in the distance H=50 mm, wind velocity V=3.11 m/s±15% or less at point P1, V=3.34 m/s±15% or less at point P2, and V=3.58 m/s±15% or less at point P3 are set as target values so that these velocities become equivalent to the fall velocity of small resin pieces 2. FIG. 3B is a graph showing wind velocity results at points P0, P1, P2, P3 at this time.

In FIG. 3A, the wind velocity distribution becomes maximum value V2 at the point of 5 mm in the Z axis direction from the surface of first upper rectifying plate 7A. Moreover, in the range of the point of 10 mm in the Z axis direction from the surface of first upper rectifying plate 7A to the surface of conveyor 1, the wind velocity distribution becomes equivalent to wind velocity V1 in the vicinity of the surface of conveyor 1. Since maximum value of the wind velocity distribution V2=24.30 m/s, and wind velocity in the vicinity of the surface of conveyor 1 V1=3.01 m/s, it can be understood that as to the ratio between the maximum value and the wind velocity in the vicinity of the surface of conveyor 1 (V2/V1), V2/V1=8.07.

When this wind velocity distribution is realized, the combined airflow spreads as it flows downward, and in FIG. 3B, it can be understood that the wind velocity distribution in which the wind velocity of the combined airflow of small resin pieces 2 on flight path T matches an increase in the fall velocity can be realized.

Figure 4A:
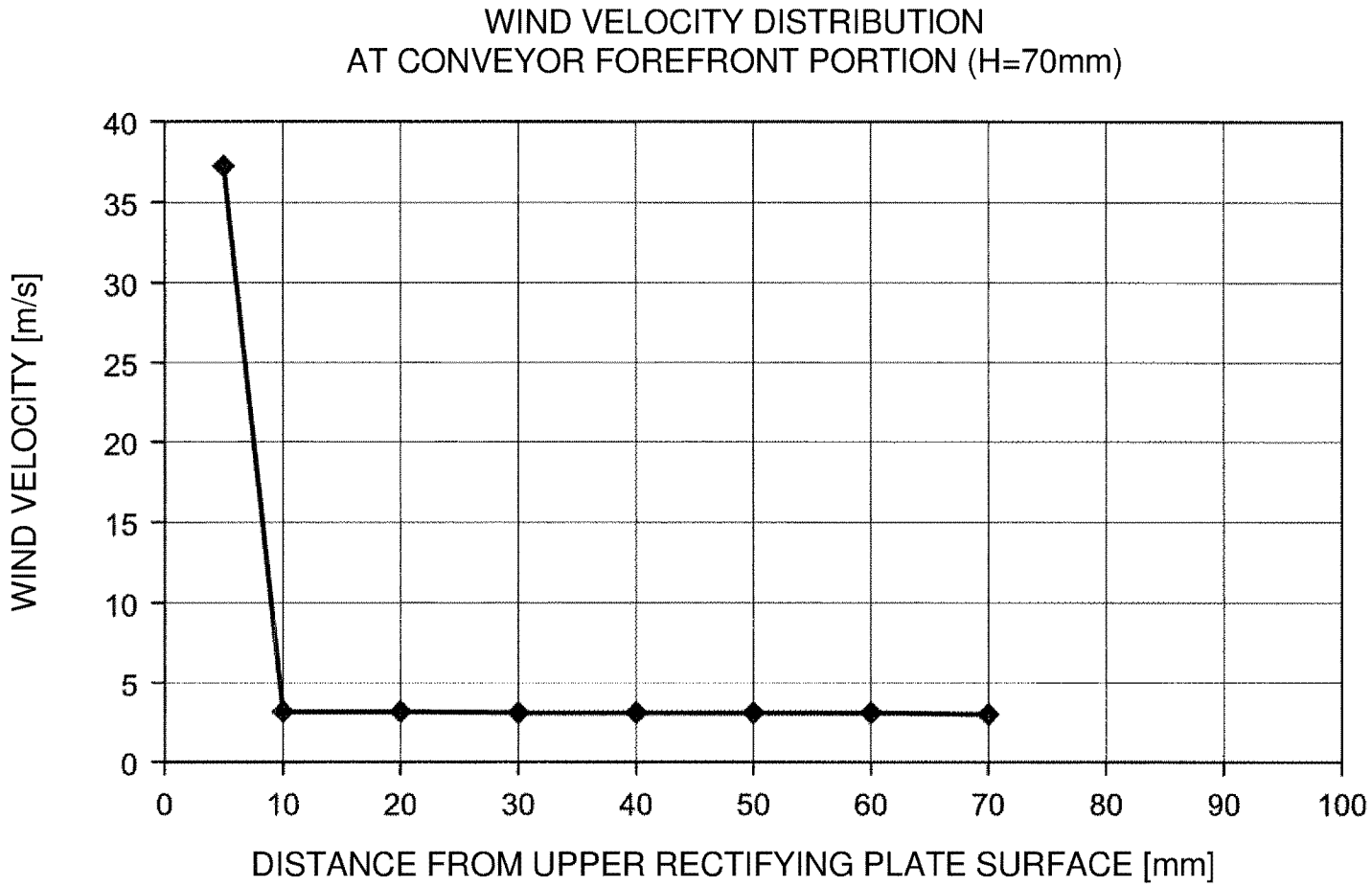
FIG. 4A is a graph showing the wind velocity distribution in the Z axis direction from the surface of the first upper rectifying plate to the surface of the conveyor at the conveyor forefront portion in distance H=70 mm.
Figure 4B:
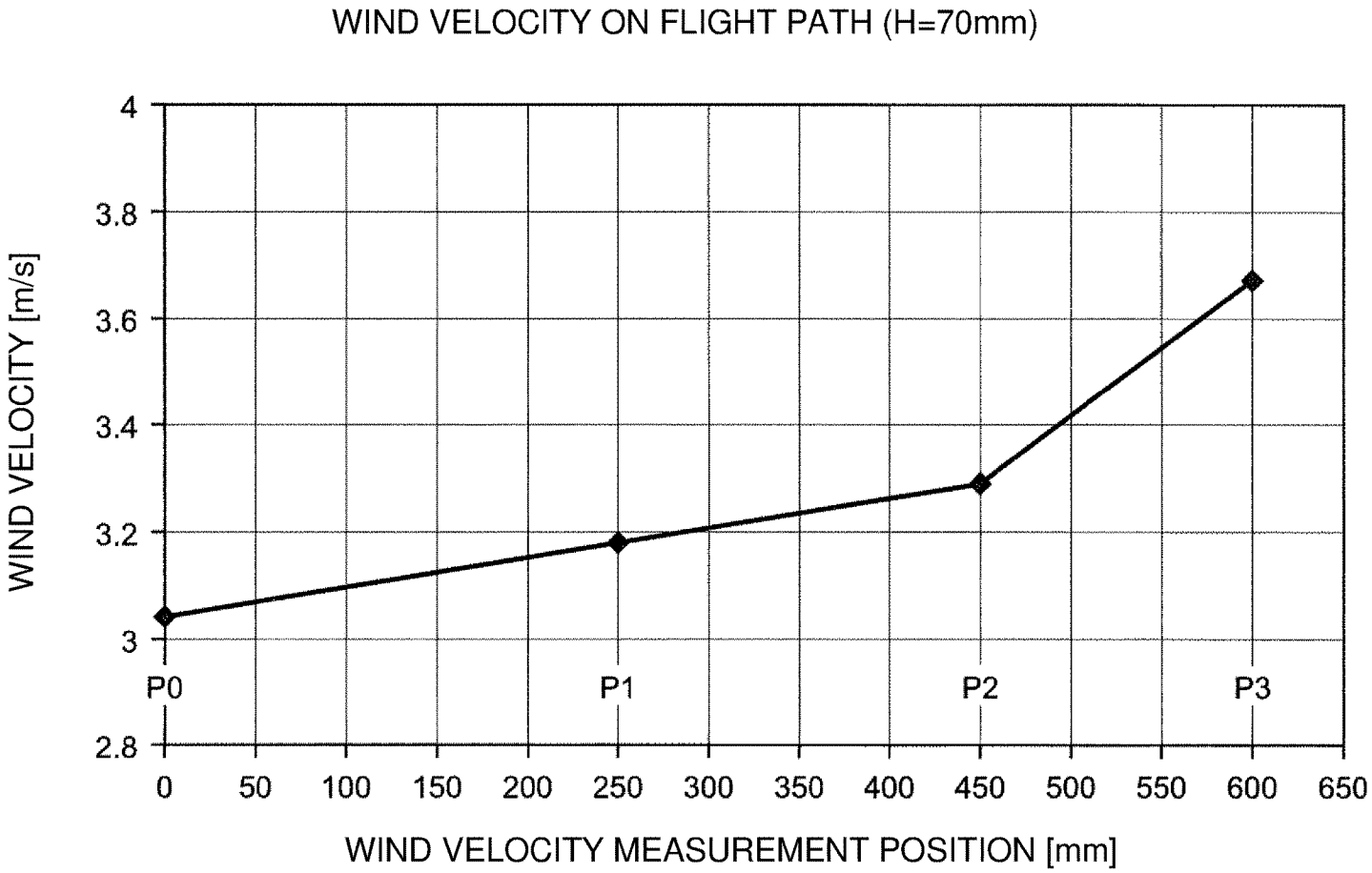
FIG. 4B is a graph showing the wind velocity distribution on the flight path of the small resin pieces in distance H=70 mm.
Figure 6:
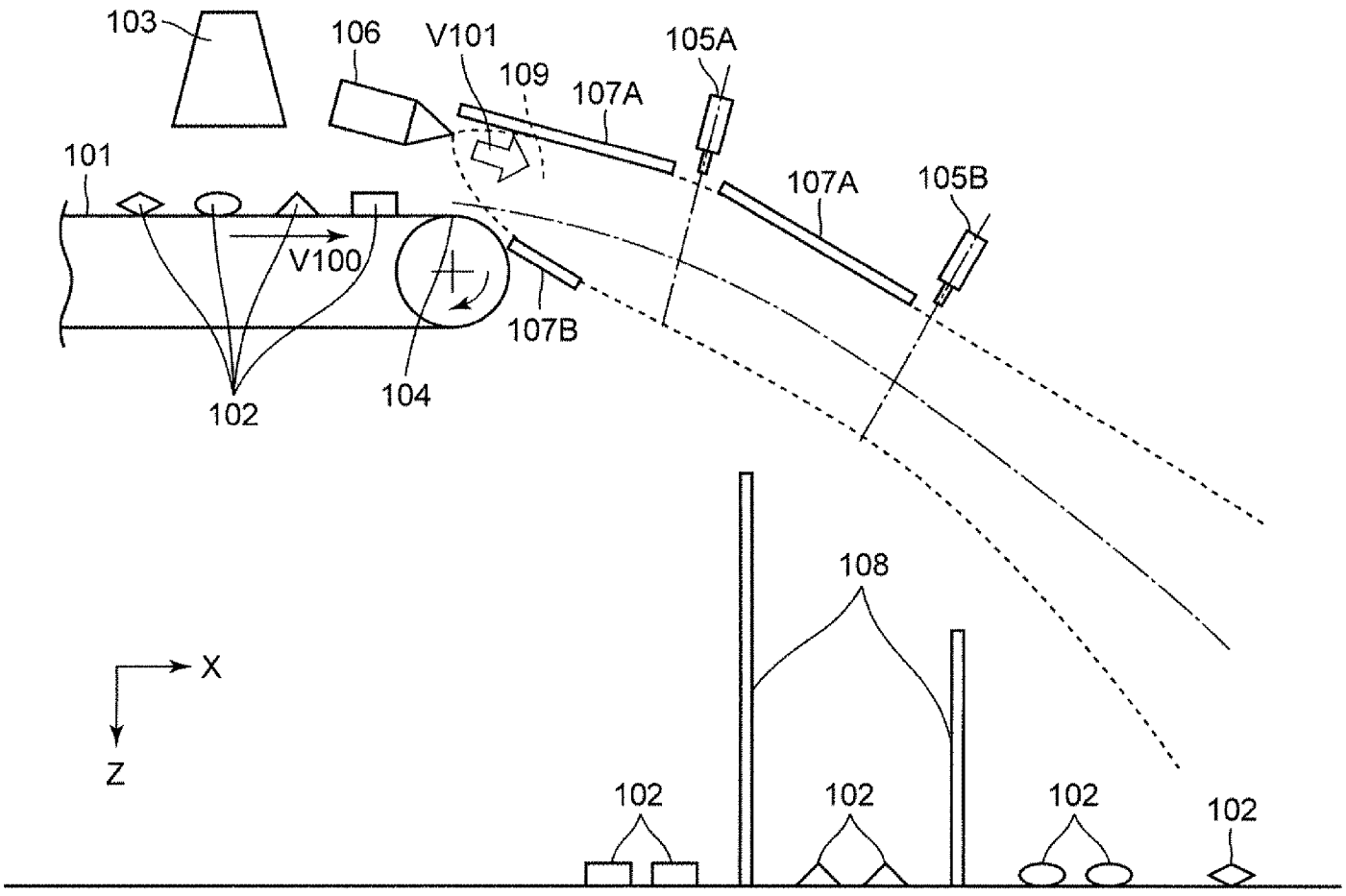
FIG. 6 is a schematic configuration diagram of a conventional sorting device.

FIG. 4A is a graph showing the wind velocity distribution in the Z axis direction from the surface of first upper rectifying plate 7A to the surface of conveyor 1 at conveyor forefront portion 4. This graph shows a state where first airflow 9 and second airflow 11 are supplied from first assist nozzle 6 and second assist nozzle 10, respectively, wherein in the distance H=70 mm, wind velocity V=3.11 m/s±15% or less at point P1, V=3.34 m/s±15% or less at point P2, and V=3.58 m/s±15% or less at point P3 are set as target values so that these velocities become equivalent to the fall velocity of small resin pieces 2. FIG. 4B is a graph showing wind velocity results at points P0, P1, P2, P3 at this time.

In FIG. 4A, the wind velocity distribution becomes maximum value V2 at the point of 5 mm in the Z axis direction from the surface of first upper rectifying plate 7A. Moreover, in the range of the point of 10 mm in the Z axis direction from the surface of first upper rectifying plate 7A to the surface of conveyor 1, the wind velocity distribution becomes equivalent to wind velocity V1 in the vicinity of the surface of conveyor 1. Since maximum value of the wind velocity distribution V2=37.21 m/s, and wind velocity in the vicinity of the surface of conveyor 1 V1=3.04 m/s, it can be understood that as to the ratio between the maximum value and the wind velocity in the vicinity of the surface of conveyor 1 (V2/V1), V2/V1=12.24.

When this wind velocity distribution is realized, the combined airflow spreads as it flows downward, and in FIG. 4B, it can be understood that the wind velocity distribution in which the wind velocity of the combined airflow of small resin pieces 2 on flight path T matches an increase in the fall velocity can be realized.

From the above-described results, the wind velocity distribution in the Z axis direction (the vertical direction) of the combined airflow from the surface of first upper rectifying plate 7A to the surface of conveyor 1 at conveyor forefront portion 4 has maximum value V2 in the range of less than 10 mm in the Z axis direction (downward of the vertical direction) from the surface of first upper rectifying plate 7A. The ratio (V2/V1) obtained by dividing maximum value V2 by wind velocity V1 in the vicinity of the surface of conveyor 1 at conveyor forefront portion 4 is 4 or more, and 12 or less. Furthermore, in the other range, as long as the combined airflow is equal to the wind velocity in the vicinity of the surface of conveyor 1 at conveyor forefront portion 4, the combined airflow spreads as it flows downstream, and the wind velocity of small resin pieces 2 on flight path T matches the increase in the fall velocity. It can be understood that with the foregoing configuration, the proper wind velocity distribution can be realized. Thus, the above-described wind velocity distribution is the proper wind velocity distribution of the combined airflow.

Furthermore, if the following conditions are each satisfied;

in distance H=30 mm, V2/V1=4.21, in distance H=50 mm, V2/V1=8.07, in distance H=70 mm, V2/V1=12.24, the wind velocity of the combined airflow can be increased along flight path T with high accuracy. Therefore, if a relationship of;

wind velocity V1 (mm/s) in the vicinity of the surface of conveyor 1, maximum value V2 (mm/s) of the wind velocity distribution in the Z axis direction from the surface of conveyor 1 at conveyor forefront portion 4 to the surface of first upper rectifying plate 7A, and shortest distance H (mm) between the surface of conveyor 1 at conveyor forefront portion 4 and the surface of first upper rectifying plate 7A mostly satisfies following expression (2), a more preferable state can be attained.

$$V2=V1\times(H-10)/5 \quad (2)$$

Figure 7:
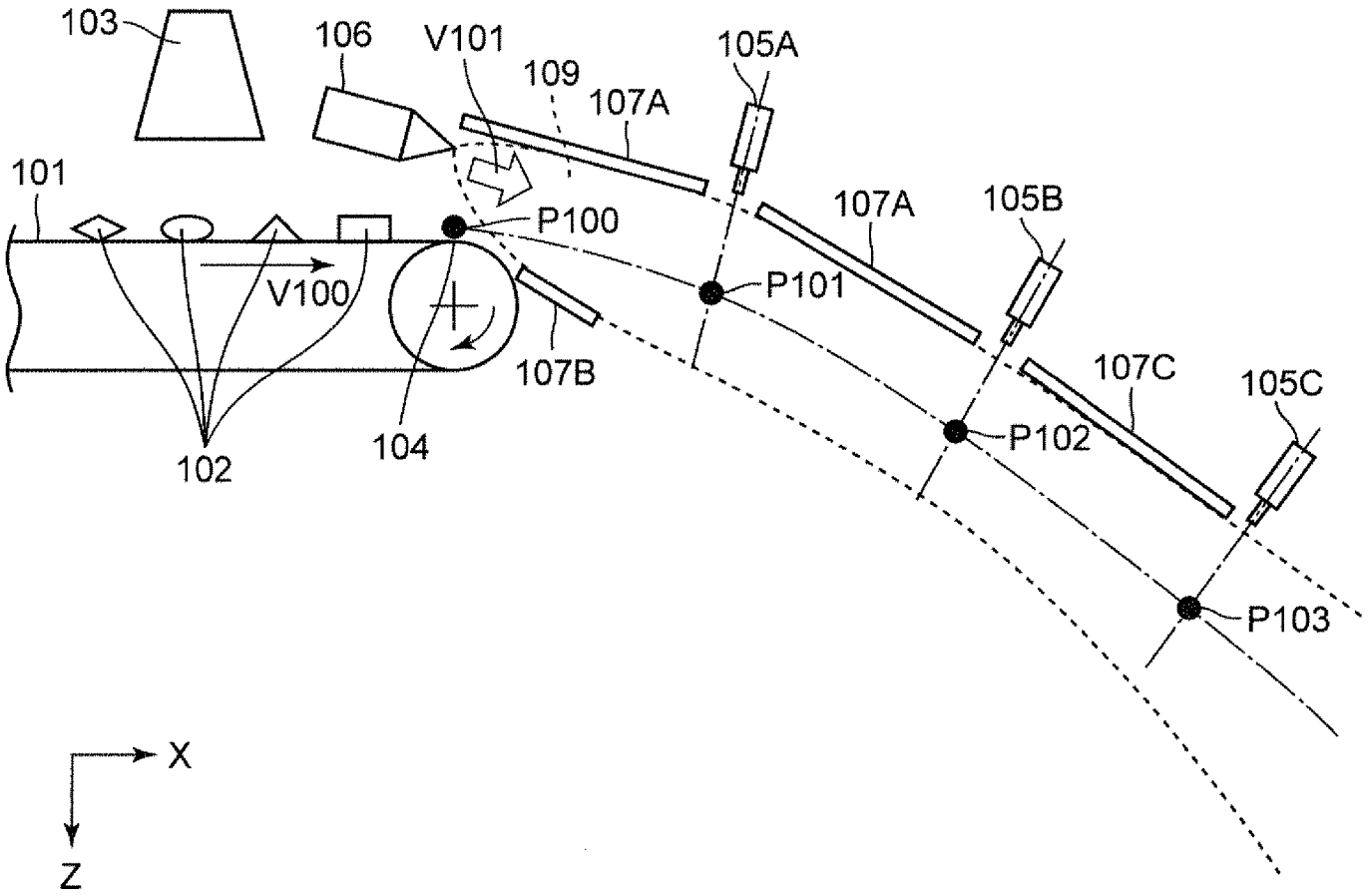
FIG. 7 is a schematic configuration diagram in which separation positions are increased in the conventional sorting device.
Figure 9A:
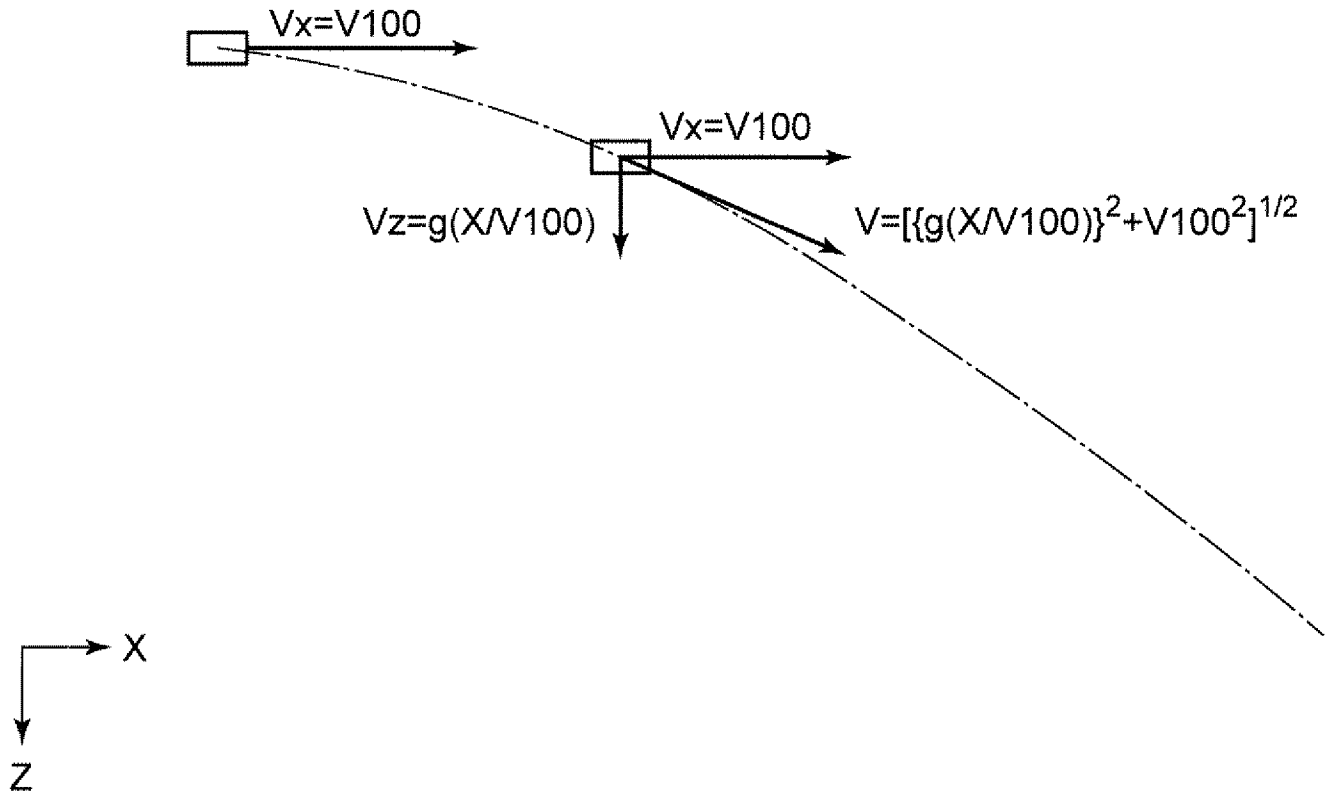
FIG. 9A is a schematic diagram for illustrating a flight velocity of the small resin piece.
Figure 9B:
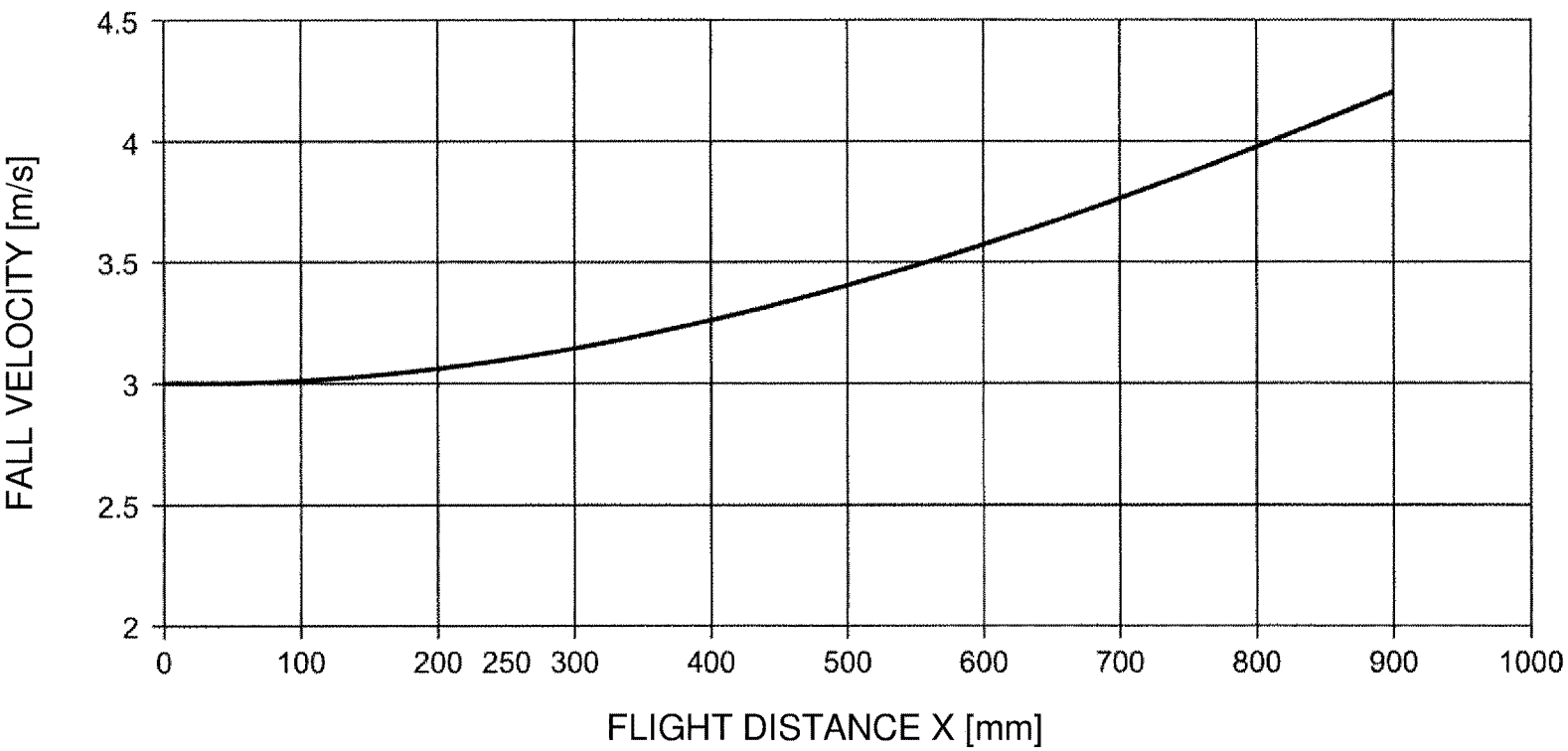
FIG. 9B is a graph in which the flight velocity of the small resin piece is calculated.

FIG. 5A is a table in which the wind velocity distribution and the flight variation are measured when in distance H=50 mm, the wind velocity distribution shown in FIG. 3A is carried out as a best condition in this example, and this example is compared with a comparative example as comparative conditions in the configuration in FIG. 7. FIG. 5B is a table in which the comparative example and the example are compared, wherein sorting accuracy in the conditions that result in the best wind velocity distribution as the best conditions of this example is measured, and the relevant sorting accuracy is compared with the sorting accuracy in the conditions when the example is not carried out in the configuration in FIG. 7 as the conditions of the comparative example.

For evaluation of the sorting accuracy, from small resin pieces 2 made of small resin pieces 2 whose material type is PS, small resin pieces 2 whose material type is PP, and small resin pieces 2 whose material type is ABS, small resin pieces 2 of PS are shot by first nozzle group 5A, small resin pieces 2 of PP are shot by second nozzle group 5B, and small resin pieces 2 of ABS are shot by third nozzle group 5C. The sorting purity and a collection rate when small resin pieces 2 are collected in first to third sections 20A, 20B, 20C partitioned by partition plates 8 are shown. As used sample grain sizes, 240 pieces of samples different in size, which is 10 mm square to 100 mm square, are used, and an average value obtained by performing the sorting three times is employed, and the sorting purity (%)=(among the small resin pieces collected in the partitioned section, a weight of the desired small resin pieces/a weight of the small resin pieces collected in the partitioned section)×100, and the collection rate (%)=(among the small resin pieces collected in the partitioned section, the weight of the desired small resin pieces/a weight of the desired small resin pieces included in all the small resin pieces before the sorting)×100 are defined. As a result, from FIG. 5A, it can be understood that in the example of the present disclosure, the wind velocity distribution along flight path T of small resin pieces 2 increases from about 3 m/s to about 3.6 m/s, while under the conditions of the comparative example in which the example is not carried out, the wind velocity distribution decreases from about 3 m/s to 2.4 m/s. Moreover, because of this, in the example of the present disclosure, flight variation 3σ is kept to be 39 mm or less, while under the conditions of the comparative example in which the example is not carried out, flight variation 3σ disadvantageously becomes 45 mm or more. From this, it can be said that the configuration in which the wind velocity is increased along flight path T can reduce the flight variation. Moreover, in FIG. 5B, in the example of the present disclosure, for PS, PP, ABS, the sorting purity of 99% or more, and the collection rate of 90% or more are assured, while under the conditions of the comparative example in which the example is not carried out, although as to PS, PP, the sorting purity of 99% or more, and the collection rate 75% or more are assured, as for ABS, the sorting purity is 92.3%, and the collection rate is 35.3%.

It can be understood that since when the example of the present disclosure is carried out, the flight variation is suppressed in all flight paths T of small resin pieces 2, the sorting accuracy of PS, PP, and ABS is all favorable.

As a result, it can be understood that the use of the sorting device in the exemplary embodiment of the present disclosure reduces the flight variation and improves the sorting accuracy by increasing the wind velocity along flight path T.

That is, the conventional sorting device has had the flight variation of resin, which enables at most two nozzle groups that inject pulse air to be installed.

In contrast, according to the exemplary embodiment of the present disclosure, the wind velocity can be increased along flight path T so that small resin pieces 2 as the sorting objects substantially do not receive air resistance. This almost substantially prevents small resin pieces 2 from receiving the air resistance regardless of the shapes, the areas, the weights of small resin pieces 2 even if the flight distance of small resin pieces 2 becomes long, and the flight variation can be suppressed, so that the shooting accuracy can be improved. In this manner, since the wind velocity is increased along flight path T so that small resin pieces 2 as the sorting objects substantially do not receive the air resistance, at least three nozzle groups 5A, 5B, 5C that inject the pulse air can be installed, the sorting device that suppresses the flight variation can be realized, and three types of resins can be simultaneously sorted.

Combining an arbitrary exemplary embodiment or modification of various exemplary embodiments or modifications as needed enables effects that each has to be exerted. Moreover, combination of exemplary embodiments, combination of examples, or combination of an exemplary embodiment and an example is possible, and combination of characteristics in different exemplary embodiments or examples is also possible.

The sorting device of the present disclosure can increase sorting purity and collection yield of small pieces of desired specific material types even when small pieces as sorting objects made of three material types are sorted individually in a series of flight path, and can be applied to resource circulation of materials as a sorting device that recycles small pieces of specific material types included in waste home electric appliances or general wastes.

What is claimed is:

1. A sorting device that sorts a specific material type matter and another material type matter from sorting objects, the sorting device comprising:

a conveyor that conveys the sorting objects in a placed state in one direction, the sorting objects having the specific material type matter and the other material type matter other than the specific material type matter mixed, and causes the sorting objects to fly at a forefront portion of the conveyor;

an identification part that identifies composition of the specific material type matter placed on the conveyor;

an air blower that generates an airflow in a flying-out direction of the sorting objects;

an upper rectifying plate disposed along a flight path of the sorting objects above the flight path;

a lower rectifying plate disposed along the flight path obliquely below the forefront portion of the conveyor under the flight path; and a plurality of injectors that are disposed above the flight path so as to be directed to the flight path, and inject pulse air to the specific material type matter flying from the conveyor, a control device configured to control operations of the conveyor, the air blower, the identification part, and the plurality of injectors, wherein the control device is configured to generate the airflow having a wind velocity distribution including a plurality of wind velocities, wherein a maximum value of the plurality of wind velocities is located less than 10 mm downward in a vertical direction from a surface of the upper rectifying plate to a surface of the conveyor at the forefront portion of the conveyor, wherein a ratio obtained by dividing the maximum value by a wind velocity of the plurality of wind velocities in the vicinity of the surface of the conveyor is 4 or more, and 12 or less, wherein the airflow has a wind velocity equal to the wind velocity in the vicinity of the surface of the conveyor in a range other than less than 10 mm from the surface of the upper rectifying plate.

2. The sorting device according to claim 1, wherein assuming that the wind velocity in the vicinity of the surface of the conveyor is defined as V1 (mm/s), the maximum value is defined as V2 (mm/s), and a shortest distance between the surface of the conveyor and the surface of the upper rectifying plate at the forefront portion of the conveyor is defined as H (mm), and the air blower controls the airflow so as to satisfy the following expression:

$$V2=V1\times(H-10)/5.$$

3. The sorting device according to claim 1, wherein the air blower is made up of a first air blower that is disposed above the forefront portion of the conveyor so that a nozzle forefront is located in the vicinity of the surface of the upper rectifying plate to supply a first airflow, and a second air blower that is disposed outside the flight path at a position behind the first air blower to supply a second airflow at a wind velocity equivalent to a conveyor conveyance velocity toward the surface of the conveyor from a blowing-out port.

4. A sorting device that sorts a specific material type matter and another material type matter from sorting objects, the sorting device comprising:

a conveyor that conveys the sorting objects in a placed state in one direction, the sorting objects having the specific material type matter and the other material type matter other than the specific material type matter mixed, and causes the sorting objects to fly at a forefront portion of the conveyor;

an identification part that identifies composition of the specific material type matter placed on the conveyor;

an upper rectifying plate disposed along a flight path of the sorting objects above the flight path;

a lower rectifying plate disposed along the flight path obliquely below the forefront portion of the conveyor under the flight path;

an air blower that generates an airflow in a flying-out direction of the sorting objects, the air blower including a first air blower disposed above the forefront portion of the conveyor so that a nozzle forefront is located in the vicinity of the surface of the upper rectifying plate to supply a first airflow and a second air blower disposed outside the flight path and at a position behind the first air blower to supply a second airflow at a wind velocity equivalent to a conveyor conveyance velocity toward the surface of the conveyor from a blowing-out port;

a plurality of injectors that are disposed above the flight path so as to be directed to the flight path, and inject pulse air to the specific material type matter flying from the conveyor; and a control device configured to control operations of the conveyor, the first and second air blowers, the identification part, and the plurality of injectors, wherein the control device is configured to control the first and second air blowers to generate the airflow having a wind velocity distribution including a plurality of wind velocities, wherein a maximum value of the plurality of wind velocities is located less than 10 mm downward in a vertical direction from a surface of the upper rectifying plate to a surface of the conveyor at the forefront portion of the conveyor, wherein a ratio obtained by dividing the maximum value by a wind velocity of the plurality of wind velocities in the vicinity of the surface of the conveyor is 4 or more, and 12 or less, wherein the airflow has a wind velocity equal to the wind velocity in the vicinity of the surface of the conveyor in a range other than less than 10 mm from the surface of the upper rectifying plate.

5. The sorting device according to claim 4, wherein assuming that the wind velocity in the vicinity of the surface of the conveyor is defined as V1 (mm/s), the maximum value is defined as V2 (mm/s), and a shortest distance between the surface of the conveyor and the surface of the upper rectifying plate at the forefront portion of the conveyor is defined as H (mm), and the air blower controls the airflow so as to satisfy the following expression:

$$V2=V1\times(H-10)/5.$$

* * * * *